US011813541B2

(12) United States Patent
Osipov

(10) Patent No.: US 11,813,541 B2
(45) Date of Patent: Nov. 14, 2023

(54) SPHERICAL 3-D PUZZLE WITH MOVING SECTORS

(71) Applicant: Ilya V. Osipov, Nizhny Novgorod (RU)

(72) Inventor: Ilya V. Osipov, Nizhny Novgorod (RU)

( * ) Notice: Subject to any disclaimer, the term of this patent is extended or adjusted under 35 U.S.C. 154(b) by 0 days.

(21) Appl. No.: 17/803,358

(22) Filed: May 31, 2022

(65) Prior Publication Data

US 2022/0296994 A1 Sep. 22, 2022

Related U.S. Application Data

(63) Continuation-in-part of application No. 16/974,148, filed on Oct. 21, 2020, now abandoned.

(51) Int. Cl.
*A63F 9/08* (2006.01)
*A63F 9/34* (2006.01)

(52) U.S. Cl.
CPC ..... *A63F 9/0865* (2013.01); *A63F 9/34* (2013.01)

(58) Field of Classification Search
CPC ..... A63F 9/0865; A63F 9/34
See application file for complete search history.

(56) References Cited

U.S. PATENT DOCUMENTS 4,513,970 A * 4/1985 Opresco ..... A63F 9/34 273/153 S
4,553,754 A * 11/1985 Wiggs ..... A63F 9/0857 273/153 S
4,886,273 A * 12/1989 Unger ..... A63F 9/34 273/455
5,628,512 A * 5/1997 Chan ..... A63F 9/0826 273/153 S
6,386,540 B1 * 5/2002 Stevkovski ..... A63F 9/0834 273/153 S
6,773,011 B1 * 8/2004 Rom ..... A63F 9/0873 273/153 S
7,887,056 B2 * 2/2011 Tenorio ..... A63F 9/1208 273/156
8,651,488 B2 * 2/2014 Mulholland ..... A63F 3/00214 273/153 R
8,850,683 B2 * 10/2014 Haughey ..... A63H 33/046 446/124
9,821,244 B1 * 11/2017 Whang ..... A63H 33/046
2014/0217671 A1 * 8/2014 Mayants ..... A63F 9/0826 273/153 S

FOREIGN PATENT DOCUMENTS

EP 3799940 A1 * 4/2021 ..... A63F 9/08
WO WO-2020021296 A1 * 1/2020 ..... A63F 9/0838

* cited by examiner

*Primary Examiner* — Steven B Wong

(57) ABSTRACT

A 3-D magnetic puzzle is implemented as sphere consisting of movable sectors configured to move about a center piece. The movable sectors are configured to host movable elements configured to change a state of the 3-D magnetic puzzle, wherein: the Movable sectors are configured to change their positioning relative to each other; and the movable sectors include sphere segments with cavities configured to accommodate the movable elements comprising permanent magnets. Each of the movable elements is configured to move inside the cavity responsive to a magnetic field provided by the permanent magnets responsive to the movable sectors change their positioning relative to each other.

10 Claims, 14 Drawing Sheets

SPHERICAL 3-D PUZZLE WITH MOVING SECTORS

CROSS-REFERENCE TO RELATED APPLICATION

This application is a CIP of the U.S. patent application Ser. No. 16/974,148 filed on 10.21.2020 and currently unintentionally abandoned.

BACKGROUND

There are currently several magnetic puzzles available. A magnet puzzle with movable sectors is disclosed in RF Patent No. 2667861, published in 2018. The disclosed puzzle uses magnetic fields to change the state of the puzzle. However, the disclosed puzzle is rather simple and easy to solve.

Accordingly, a complex and hard to solve spherical 3-D puzzle with magnets and movable sectors is desired.

SUMMARY OF THE INVENTION

Disclosed herein is the 3-D puzzle is implemented as sphere divided by an equator consisting of multiple movable sectors configured to move about a central piece. All movable sectors may have an outer surface and an inner surface configured to house magnets. The relative positioning of the movable sectors can be changed.

The movable sectors are configured to host movable elements configured to change a state of the 3-D magnetic puzzle. The movable sectors are configured to change their positioning relative to each other; and the movable sectors include sphere segments with cavities configured to accommodate the movable elements comprising permanent magnets. Each of the movable elements is configured to move inside the cavity responsive to a magnetic field provided by the permanent magnets responsive to the movable sectors change their positioning relative to each other.

These and other features of the concepts provided herein will become more apparent to those of skill in the art in view of the accompanying drawings and following description, which describe particular embodiments of such concepts in greater detail.

BRIEF DESCRIPTION OF DRAWINGS

A more particular description of the present disclosure will be rendered by reference to specific embodiments thereof that are illustrated in the appended drawings. It is appreciated that these drawings depict only typical embodiments of the invention and are therefore not to be considered limiting of its scope. Example embodiments of the invention will be described and explained with additional specificity and detail through the use of the accompanying drawings in which.

DETAILED DESCRIPTION

Figure 1:
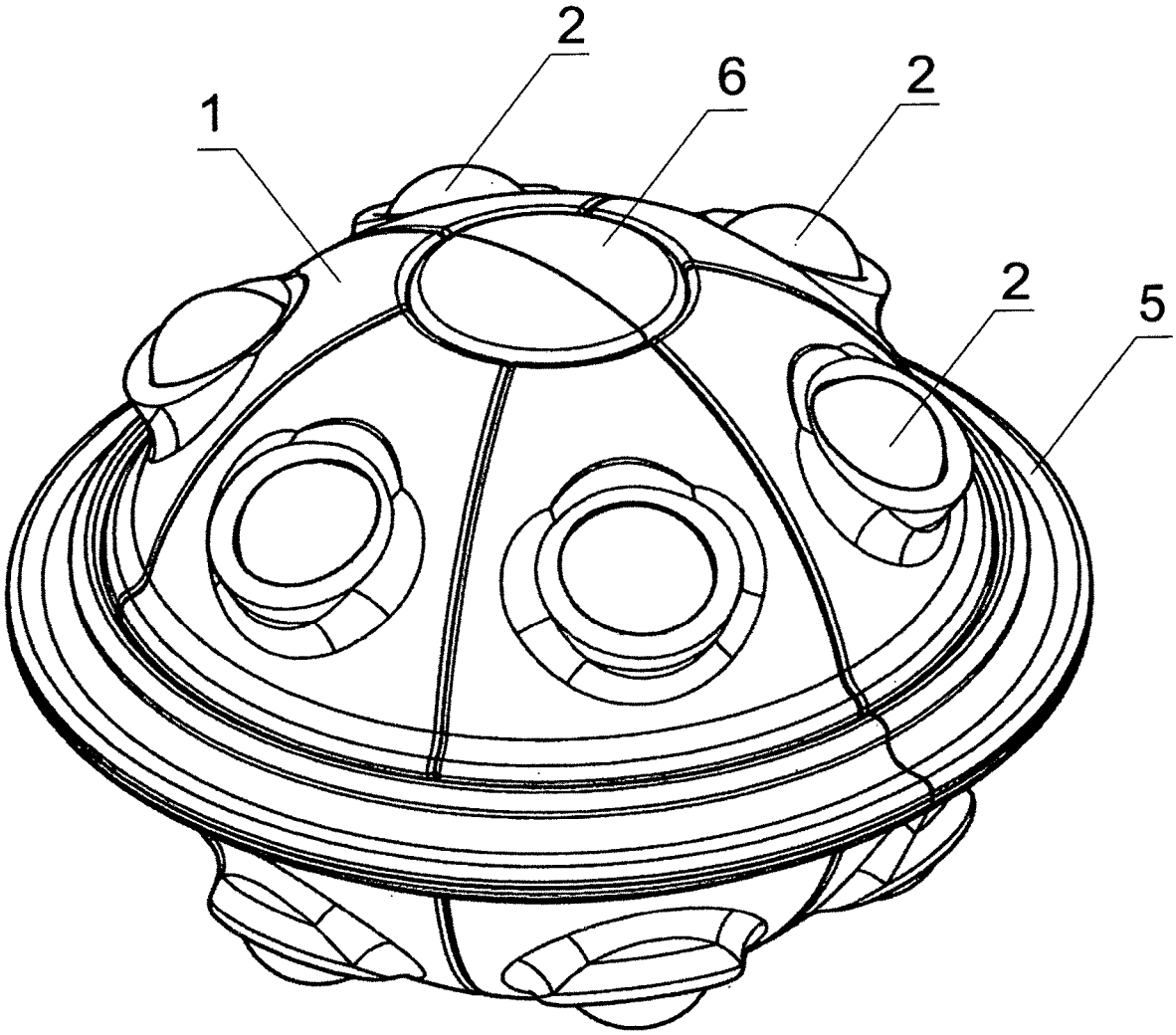
FIG. 1 illustrates a view of the 3-D puzzle in an initial ordered state, according to the exemplary embodiment.
Figure 2:
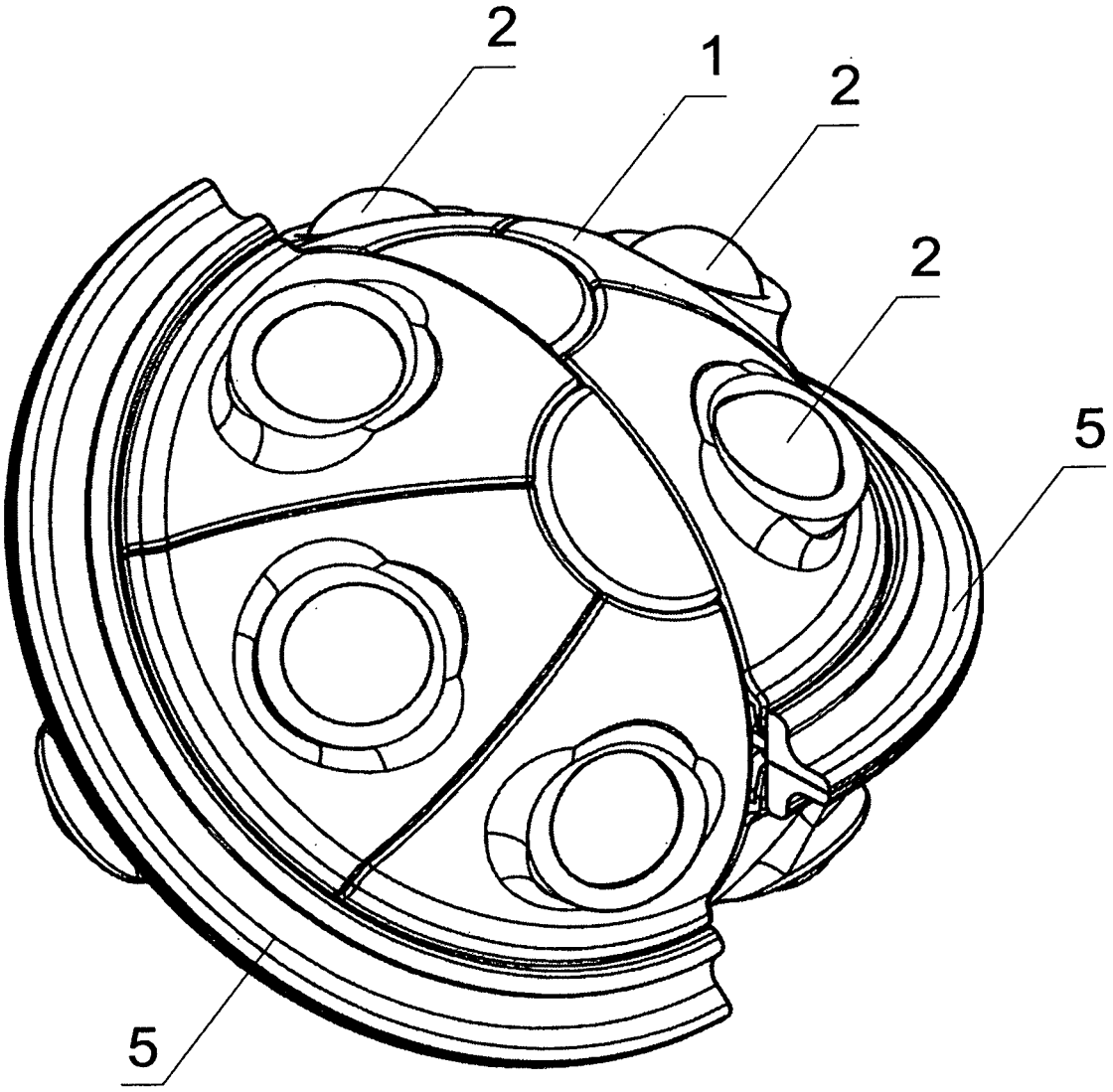
FIG. 2 illustrates a view of the 3-D puzzle in a rotated state when a hemisphere is twisted, according to the exemplary embodiment.
Figure 3:
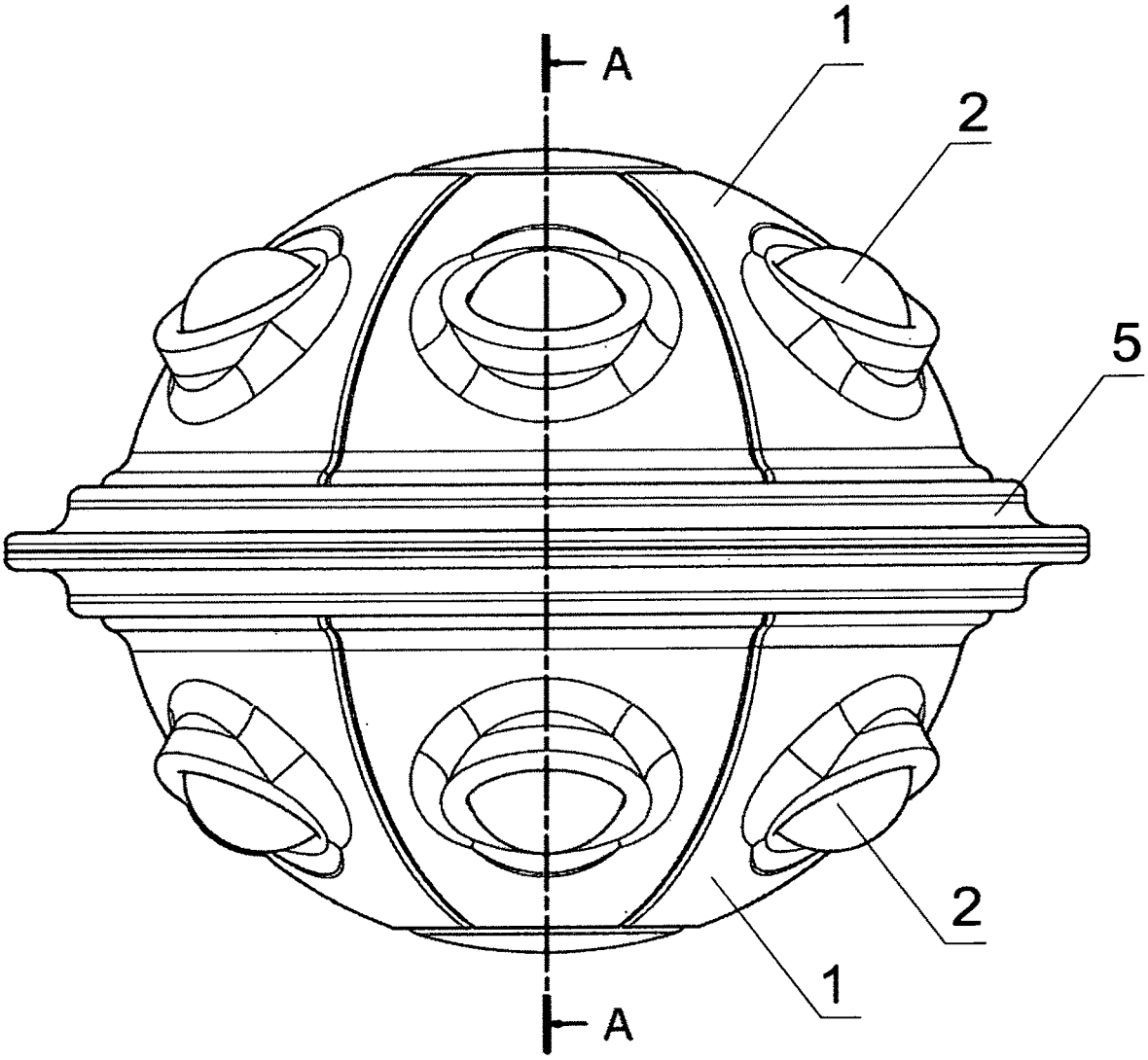
FIG. 3 illustrates a side view of the 3-D puzzle in the initial position, according to the exemplary embodiment.

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

For clarity, it is to be understood that the word "distal" refers to a direction relatively closer to a patient on which a medical device is to be used as described herein, while the word "proximal" refers to a direction relatively further from the patient. Also, the words "including," "has," and "having," as used herein, including the claims, shall have the same meaning as the word "comprising."

Lastly, in the following description, the terms "or" and "and/or" as used herein are to be interpreted as inclusive or meaning any one or any combination. As an example, "A, B or C" or "A, B and/or C" mean "any of the following: A; B; C; A and B; A and C; B and C; A, B and C." An exception to this definition will occur only when a combination of elements, components, functions, steps or acts are in some way inherently mutually exclusive.

Unless defined otherwise, all technical and scientific terms used herein have the same meaning as commonly understood by those of ordinary skill in the art.

Embodiments disclosed herein are directed to a magnetic 3-D spherical puzzle with movable sectors configured to be repositioned relative to each other. The sectors may have movable elements providing for various states of the 3-D puzzle.

According to the exemplary embodiments, the 3-D puzzle is implemented as a sphere consisting of multiple movable sectors configured to move about a central piece. All movable sectors have an outer surface and an inner surface configured to house magnets. The relative positioning of the movable elements can be changed by a user. According to the exemplary embodiment, the magnets interact with each other by pairs in any static position of the spherical 3-D puzzle. As a result, the movable elements are either being pulled to the center or being pushed away from the center.

Accordingly, the elements of the 3-D puzzle may move by principle similar to the one of the Rubik's cube. However, the exemplary 3-D puzzle does not use colors for the movable sectors. Instead, the movable sectors of the sphere use round ball-like elements positioned on every movable sector. The ball-like elements can be either in one or another color-coded binary state.

Since the 3-D puzzle has magnets positioned inside, at each turn of a segment of the puzzle, a new interaction of magnet pairs occurs. Magnetic pull/push causes repositioning of the movable sectors that change the appearance of the 3-D puzzle.

In one embodiment, the plates with static magnets may be shaped as disks. Thus, regardless of a static position of the 3-D puzzle, the magnets always interact with each other by pairs causing the movable sectors to be either pulled to the center or be pushed away from the center thereby creating different variations of the 3-D puzzle.

In one embodiment, the plates housing the static magnets include four magnets each. Thus, regardless of a static position of the 3-D puzzle, the magnets always interact with each other by pairs.

As discussed above, the spherical 3-D puzzle magnetic puzzle is made in the form of a three-dimensional sphere divided by an equatorial belt into two hemispheres—the northern and the southern hemisphere, each of which consists of an even number of equal movable sectors having cavities in which movable elements with magnetic properties are located. The movable elements may have two different coatings, depending on the orientation of the magnetic field. At least one coating becomes accessible on the outside. The puzzle is constructed to allow for rotating of the movable sectors of the northern and of the southern hemisphere relative to the north-south axis. There magnets are located in the movable sectors to ensure the fixation of the moving elements of the puzzle in its various static positions.

In one embodiment, the equatorial belt consists of an even number of equal fragments that allow for the 180-degree rotation of two hemispheres of the puzzle (western and eastern) relative to two mutually perpendicular axes, each of which is perpendicular to the north-south axis. The puzzle may have a center piece relative to which the sectors may move. The magnets interacting with moving elements are located in the center piece, so that in any static position of a spheric 3-D magnetic puzzle, the magnets interact with each other in pairs. As a result, all movable elements may be facing outward with only one of their coatings.

Thanks to the above advantageous characteristics, it becomes possible to use the magnets and other movable elements made of a material with magnetic susceptibility as essential features of the puzzle structure itself in the absence of any guides. The multivariance of their location in different stationary positions of the segments of the spherical puzzle is provided by rotation and magnetic interaction and is used to increase the number of different positions of the spherical puzzle, which ensures its complexity and variety of possible positions.

Rotations of magnets and elements made of a material with magnetic susceptibility is facilitated by attraction and repulsion of various magnets. The proposed solution is simple and convenient to hold in user's hands, as well as to rotate. Alternatively, the puzzle can be made in the form of an ellipse or a polyhedron. In one embodiment, the movable elements may be made in the form of balls. In this case, it becomes possible to simply perform rotations of the movable elements in the form of balls that can rotate in one place. In one embodiment, the balls may have two different coatings of different colors which provides for a better visual implementation. In yet another embodiment, the balls' coatings may be of different textures that are different to the touch. This enables blind or visually impaired user to solve the puzzle.

The FIGS. 1-18 described below use the following numbering of the exemplary features and elements:

1—movable sectors;
2—movable elements;
21—magnets of the movable element;
22—movable element housing;
3—additional magnets;
4—cavity;
5—equatorial belt part;
6—pole part; and
7—central piece (bushing).

According to the exemplary embodiments, FIGS. 1-18 depict the 3-D spherical puzzle and its parts including movable sectors 1 configured to change the relative positions to each other. The locations of the movable elements 2 may form various states of the exemplary magnetic puzzle. Portions of the movable elements 2 are connected to permanent magnets. The movable sectors 1 have cavities in which the movable elements 2 may be located. Each movable element is configured to fit into the cavity 4 under the force from other permanent magnets of the puzzle when the relative position of the movable sectors relative to each other changes.

As discussed above, the 3-D magnetic puzzle is made in the form of a sphere divided by an equatorial belt into two hemispheres—the northern and southern. Each of the hemispheres consists of an even number of equal movable sectors having cavities in which movable elements with magnetic properties are located. The exemplary FIGs. show six sectors. However, an arbitrary number of sectors may be used.

The movable elements 2 may have two different color coatings. Depending on the orientation of the magnetic field, one of the two coatings becomes accessible (pointed outward) on the outside. The 3-D spherical magnetic puzzle is constructed to allow for rotating of the movable sectors of the northern and the southern hemispheres relative to the north-south axis.

The movable sectors may have additional magnets 3 (see FIG. 13), which ensure the fixation of the movable elements 2 of the puzzle in its various static positions. However, there may also be optional magnets that enhance the fixation of the puzzle. The equatorial belt 5 consists of an even number of equal fragments that may allow for the rotation of the two hemispheres (the western and eastern) of the puzzle by 180 degrees relative to two mutually perpendicular axes, each of which is perpendicular to the north-south axis.

The volumetric magnetic puzzle has a center piece 7 (see FIG. 4), relative to which the movable sectors 1 move. Magnets interacting with movable elements 2 are located in the center piece 7, so that in any static position of the 3-D magnetic puzzle, the magnets interact with each other in pairs. As a result, all movable elements 2 are facing outward with only one of two of their coatings.

Figure 4:
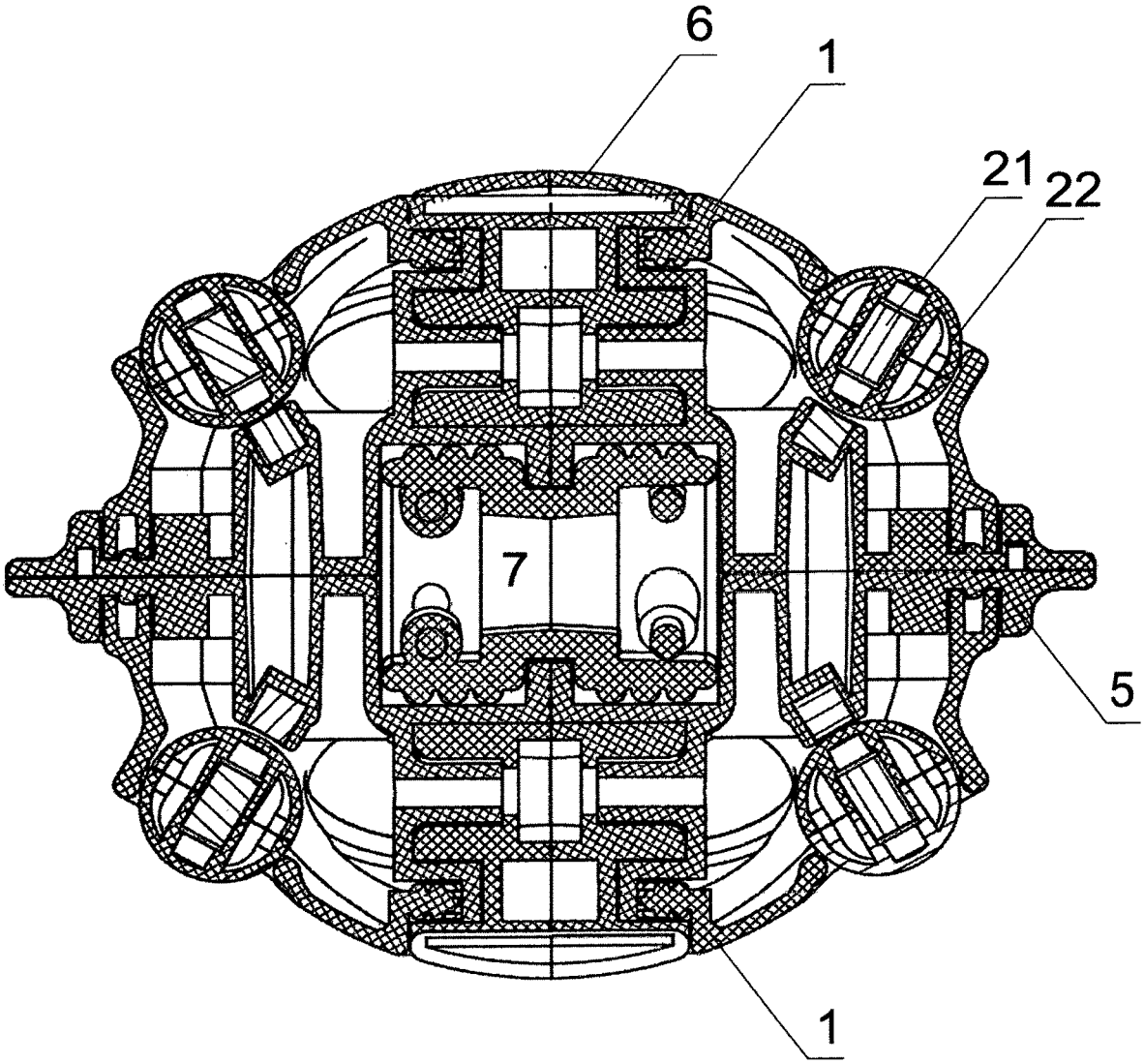
FIG. 4 illustrates a cross-section A-A view of the puzzle depicted in FIG. 3, according to the exemplary embodiment.
Figure 5:
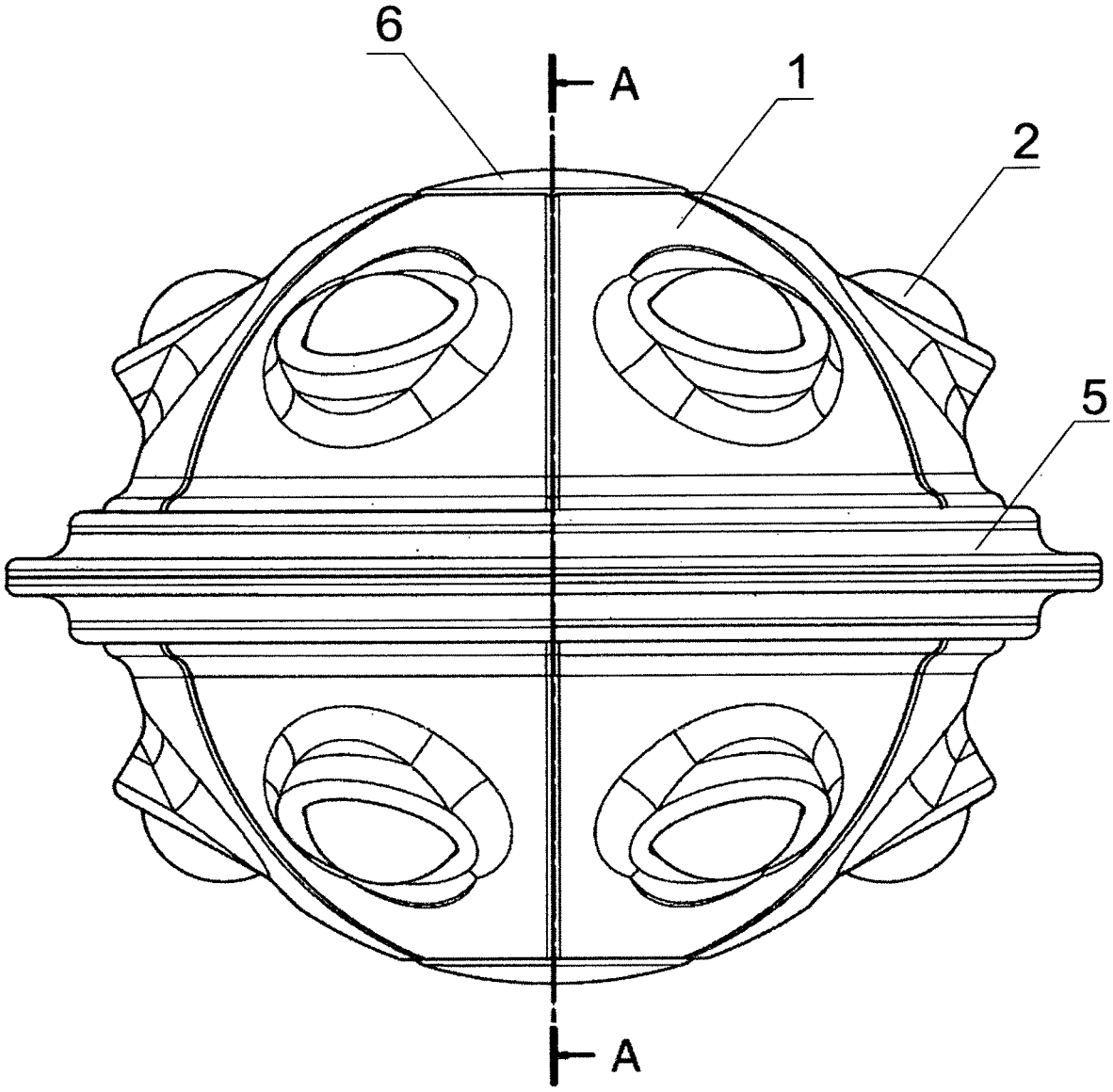
FIG. 5 illustrates another view of the puzzle depicted in FIG. 1, according to the exemplary embodiment.
Figure 6:
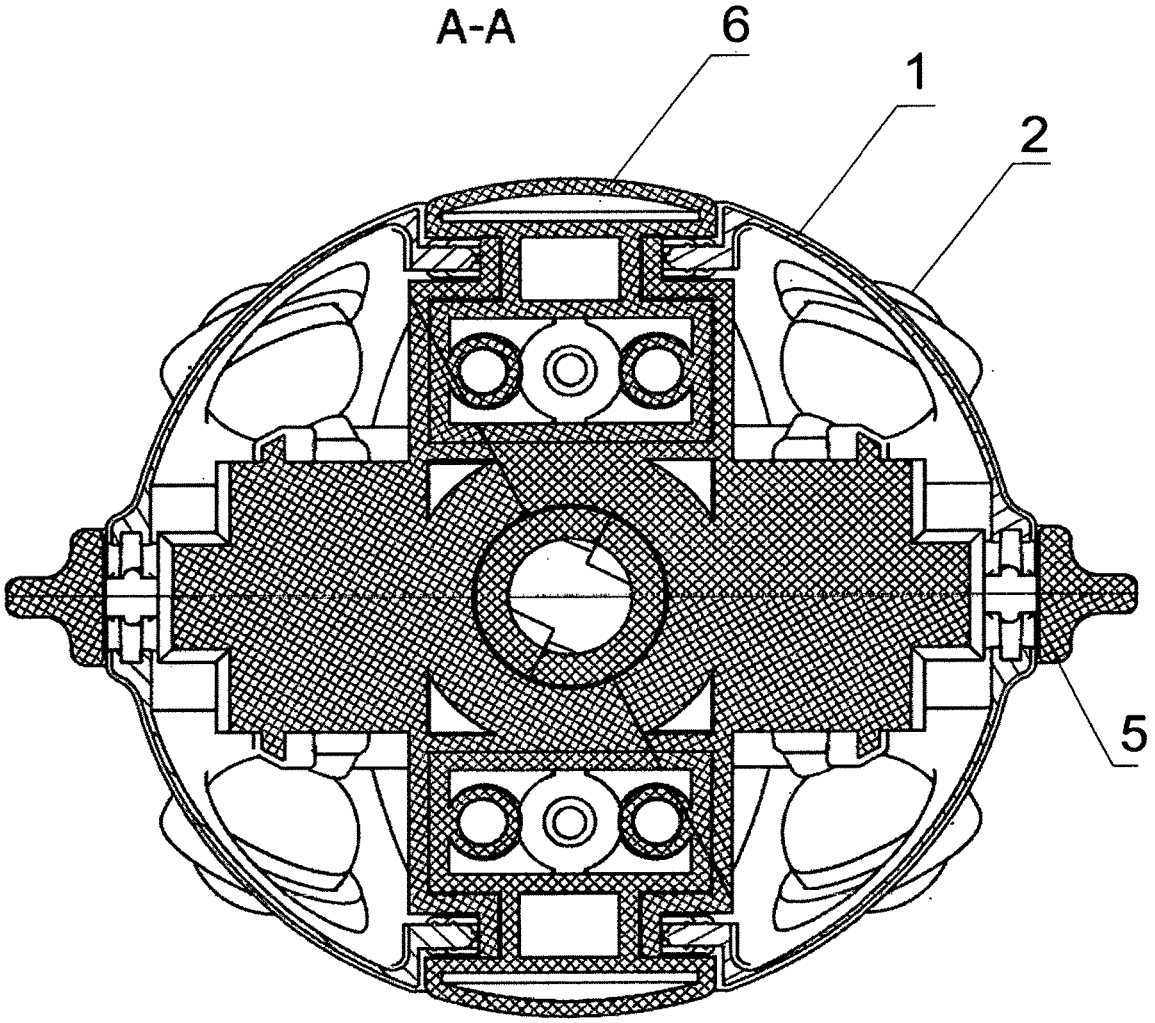
FIG. 6 illustrates a vertical cross-section A-A view of the puzzle depicted in FIG. 5, according to the exemplary embodiment.
Figure 7:
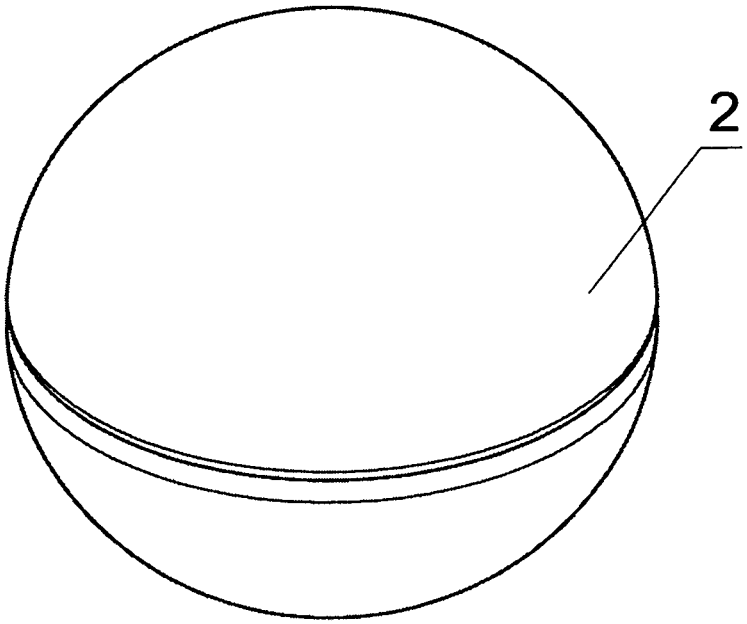
FIG. 7 illustrates a movable element of the puzzle, according to the exemplary embodiment.
Figure 8:
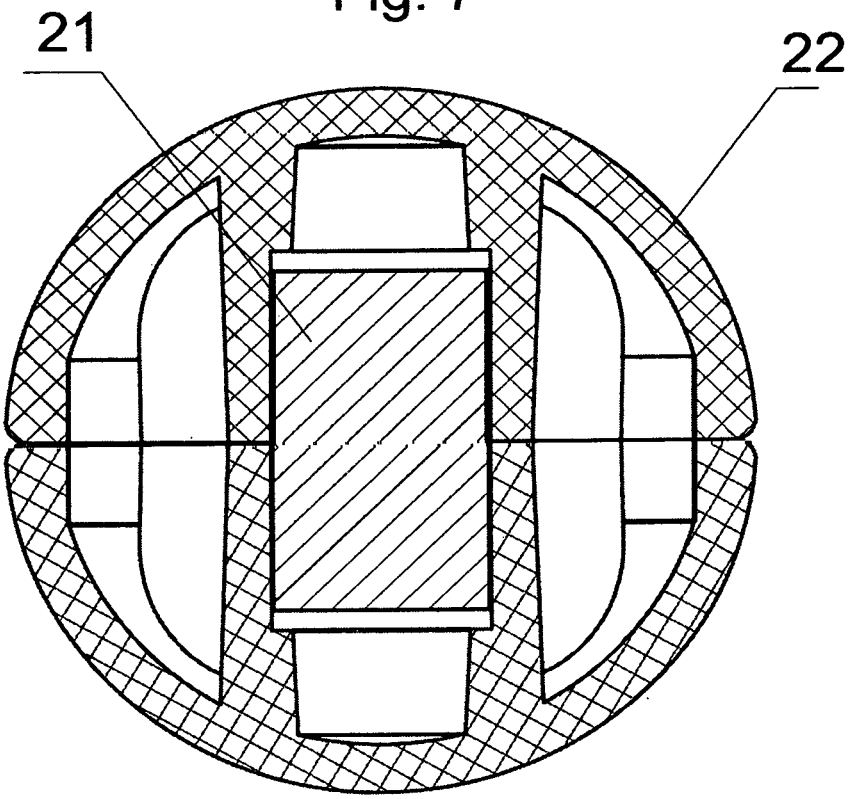
FIG. 8 illustrates a cross-section view of the movable element depicted in FIG. 7, according to the exemplary embodiment.
Figure 9:
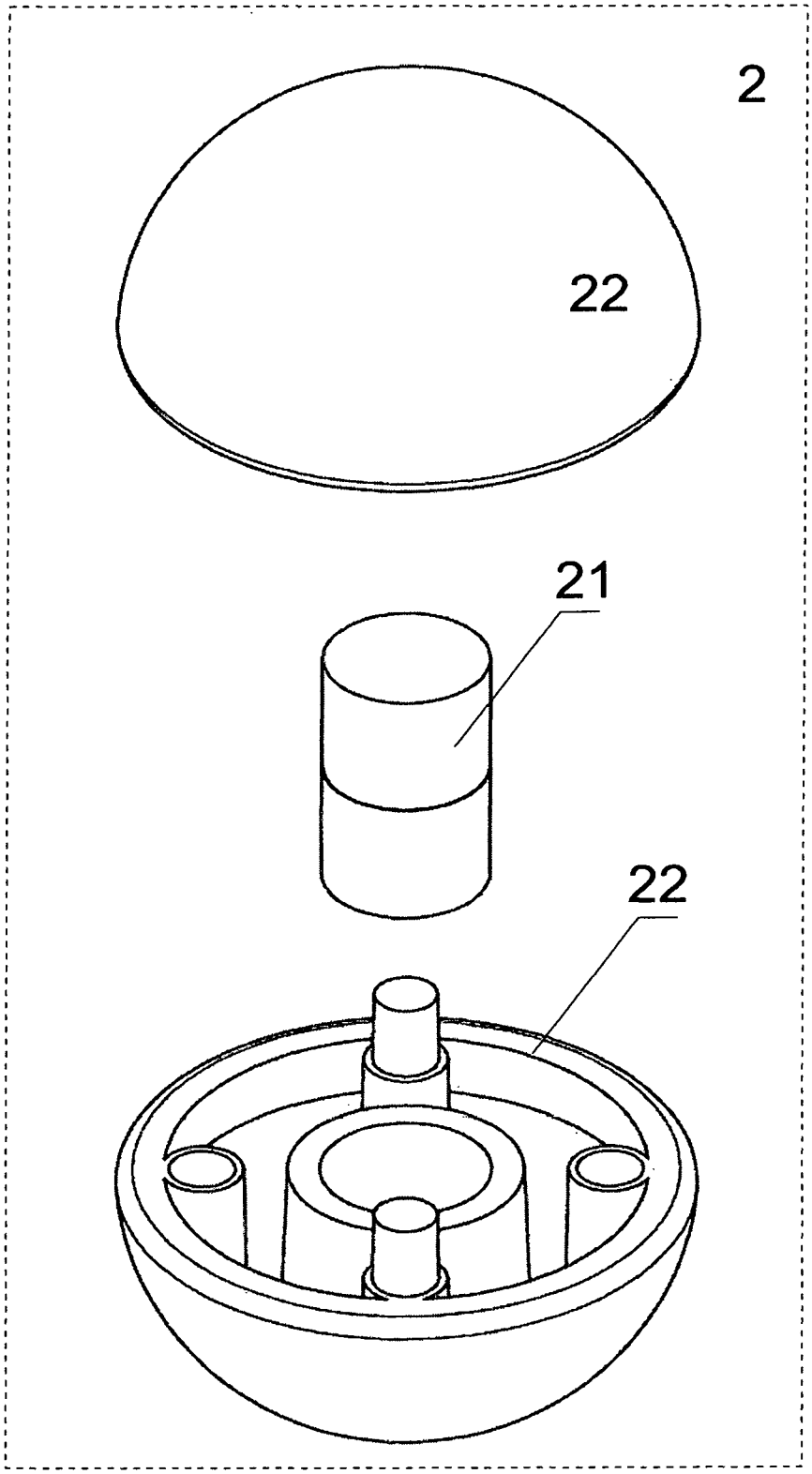
FIG. 9 illustrates a disassembled movable element depicted in FIG. 8, according to the exemplary embodiment.
Figure 10:
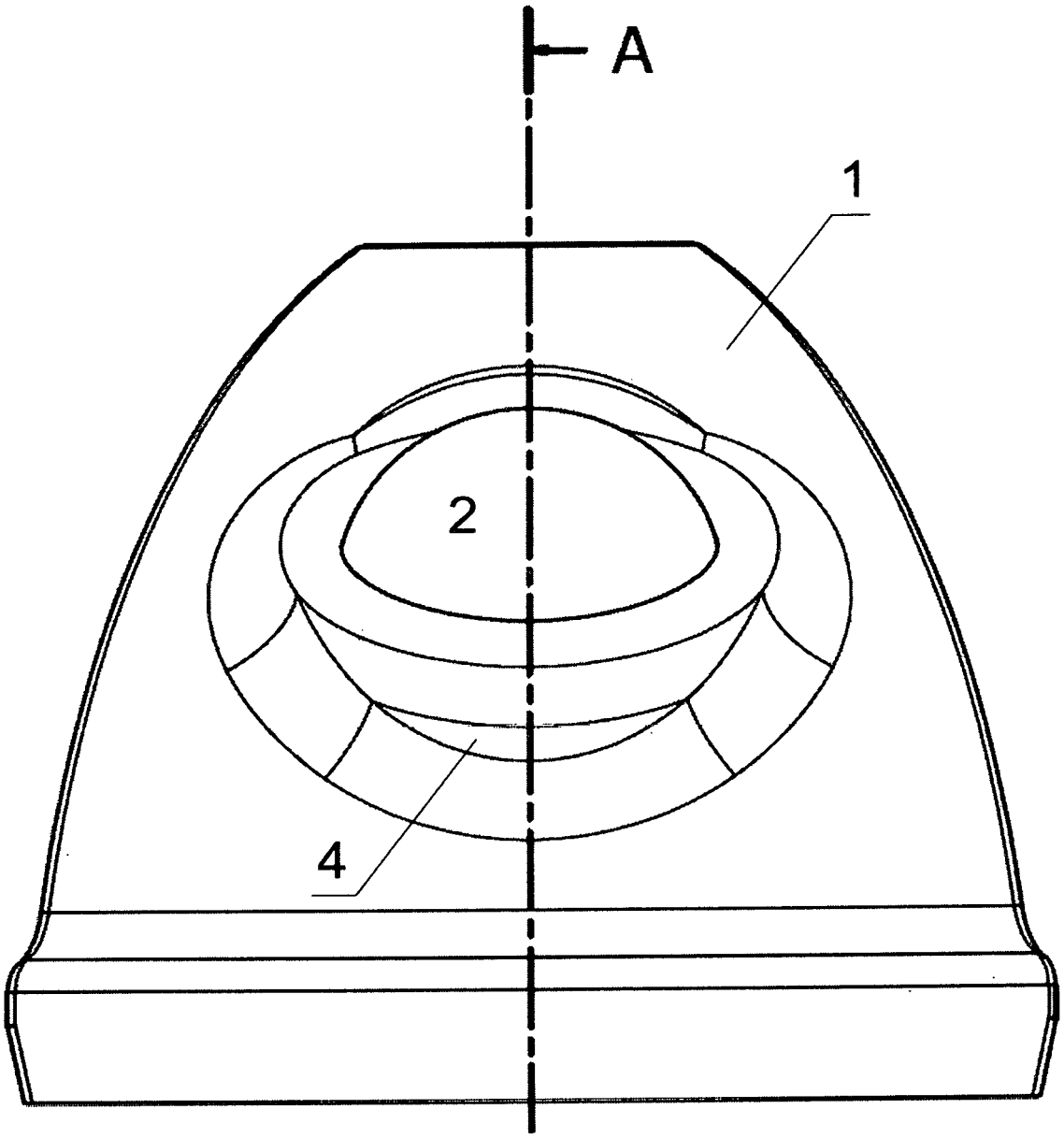
FIG. 10 illustrates a movable sector of the 3-D puzzle depicted in FIG. 1, according to the exemplary embodiment.
Figure 11:
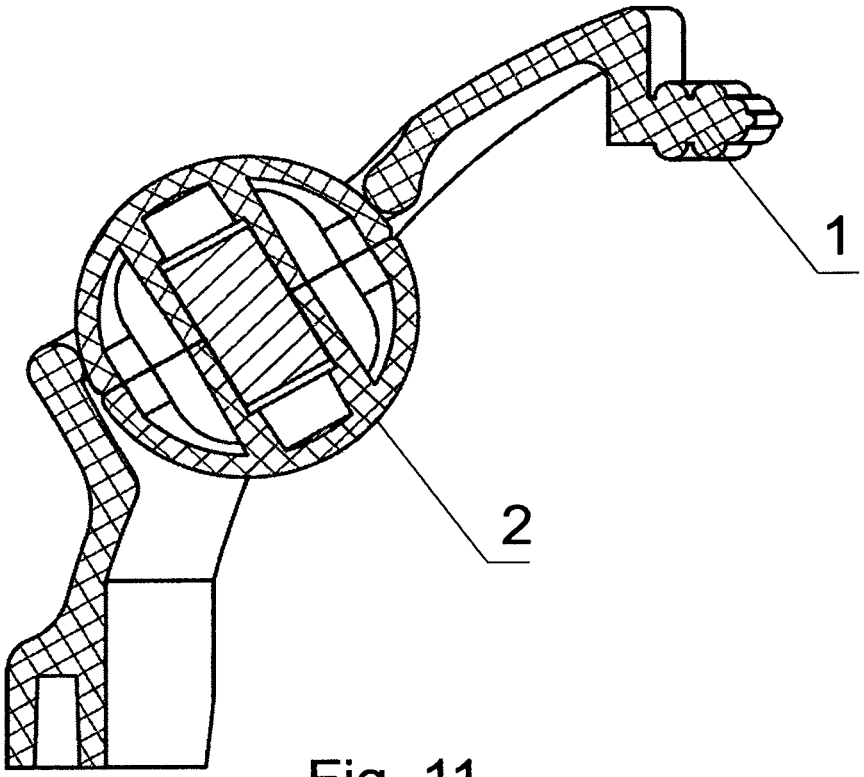
FIG. 11 illustrates a cross-section A of the movable sector of the 3-D puzzle depicted in FIG. 10, according to the exemplary embodiment.
Figure 12:
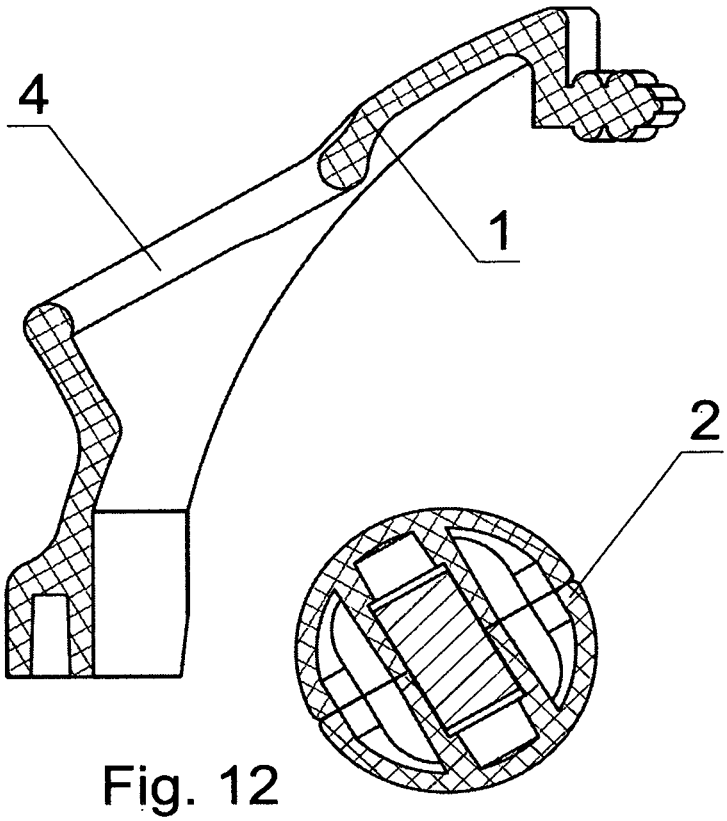
FIG. 12 illustrates another cross-section of the movable sector of the 3-D puzzle depicted in FIG. 11, according to the exemplary embodiment.
Figure 13:
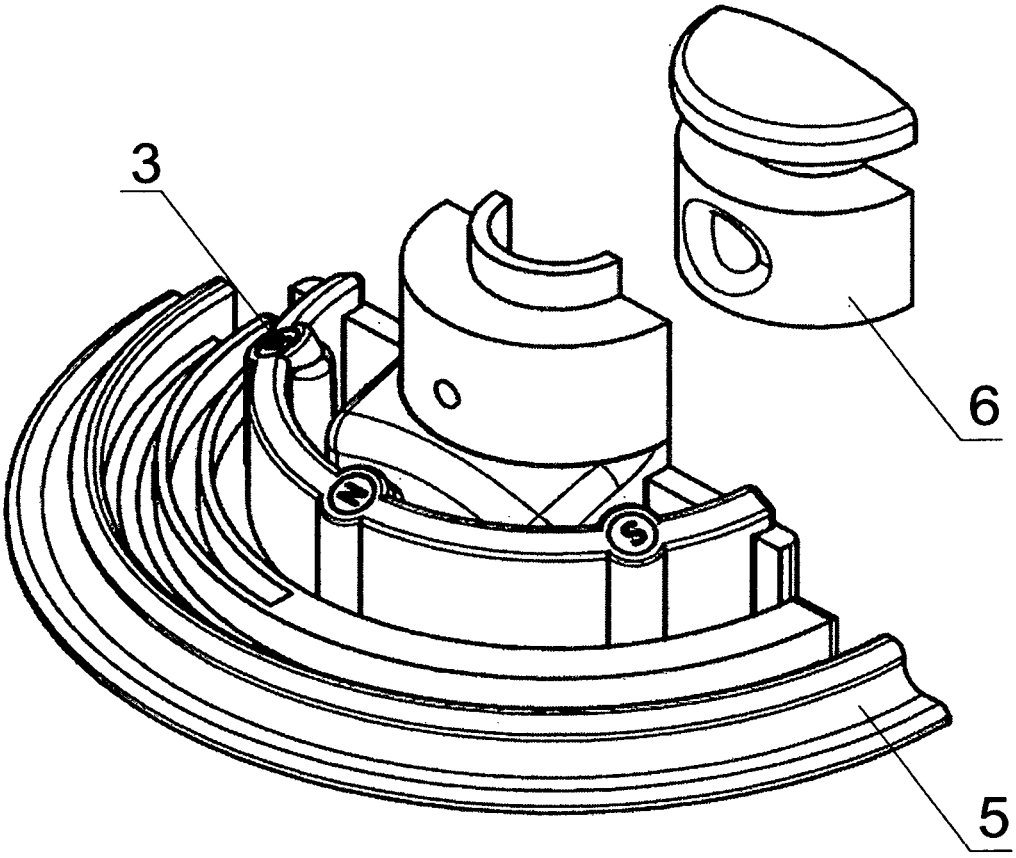
FIG. 13 illustrates an equatorial part with a separate pole part of the 3-D puzzle depicted in FIG. 1, according to the exemplary embodiment.
Figure 14:
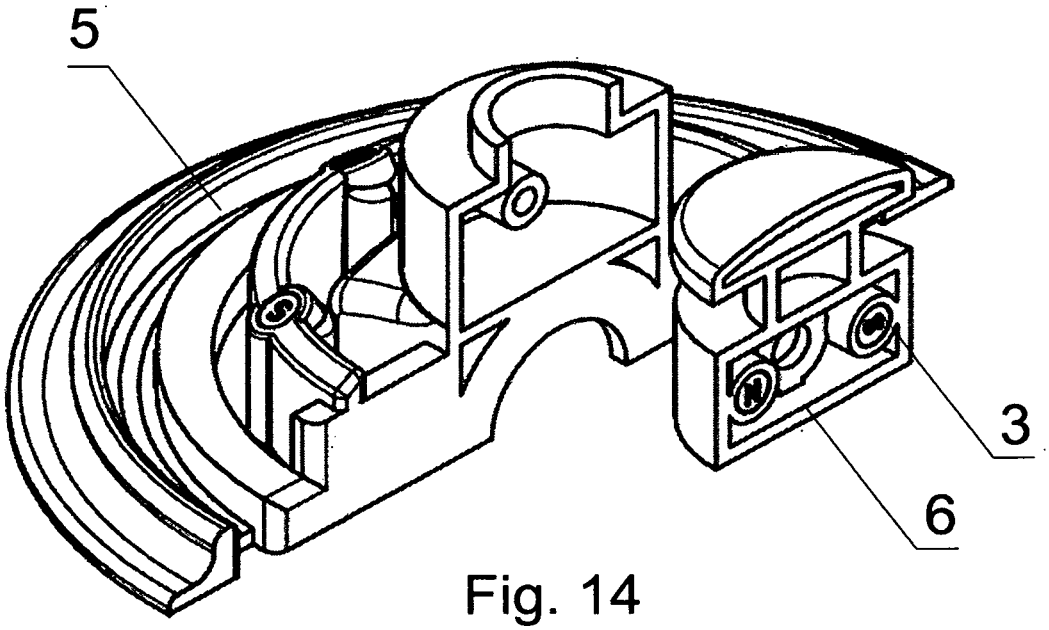
FIG. 14 illustrates another view of the equatorial part with the pole part of the 3-D puzzle depicted in FIG. 1, according to the exemplary embodiment.
Figure 15:
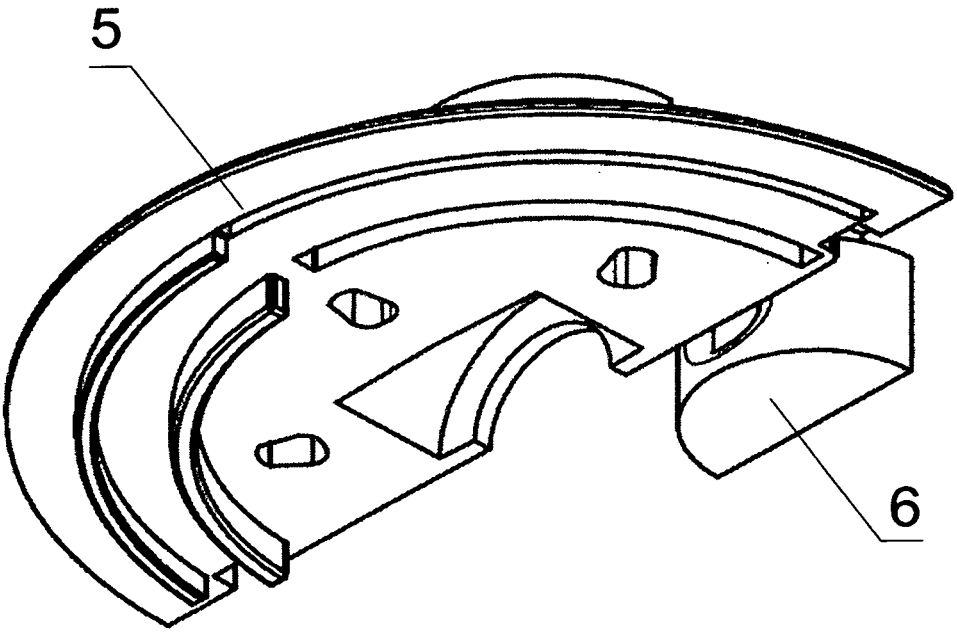
FIG. 15 illustrates a bottom view of the equatorial part of the 3-D puzzle depicted in FIG. 1, according to the exemplary embodiment.
Figure 16:
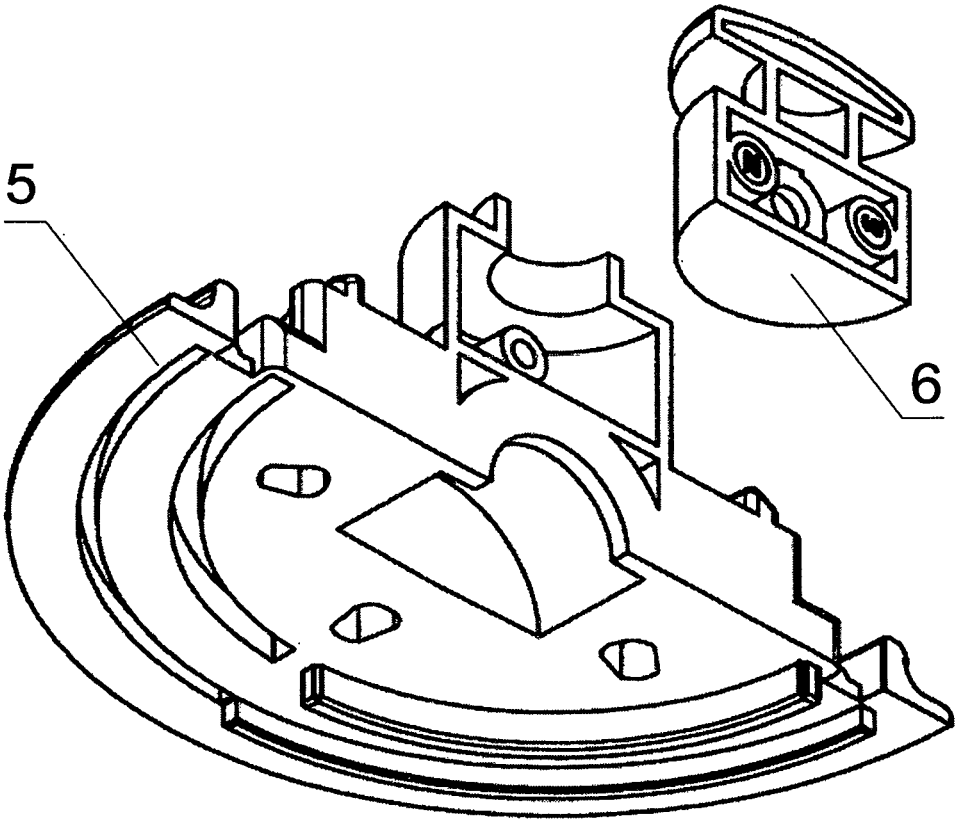
FIG. 16 illustrates an additional view of the equatorial part with the pole part of the 3-D puzzle depicted in FIG. 1, according to the exemplary embodiment.
Figure 17:
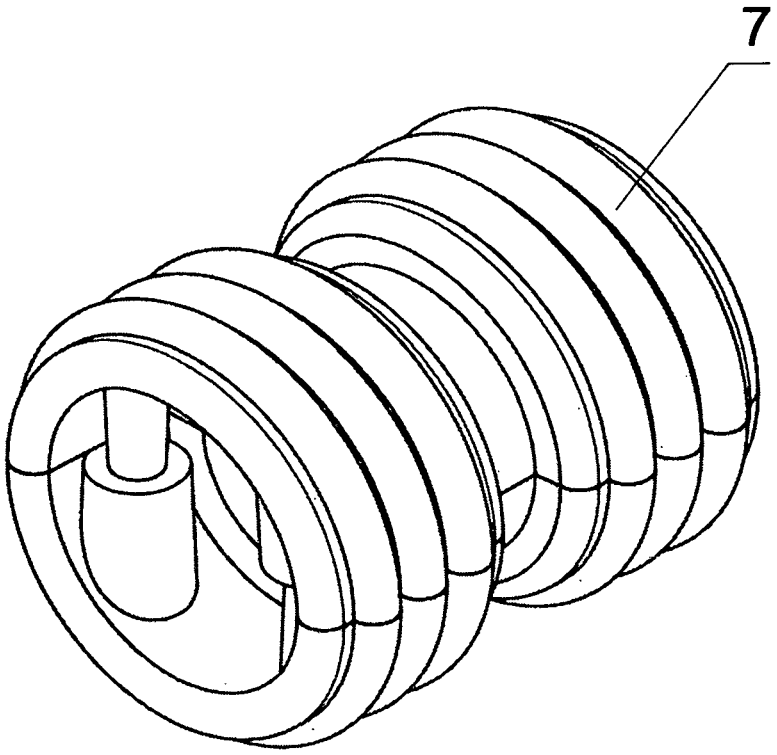
FIG. 17 illustrates a central piece of the 3-D puzzle depicted in FIG. 1, according to the exemplary embodiment.
Figure 18:
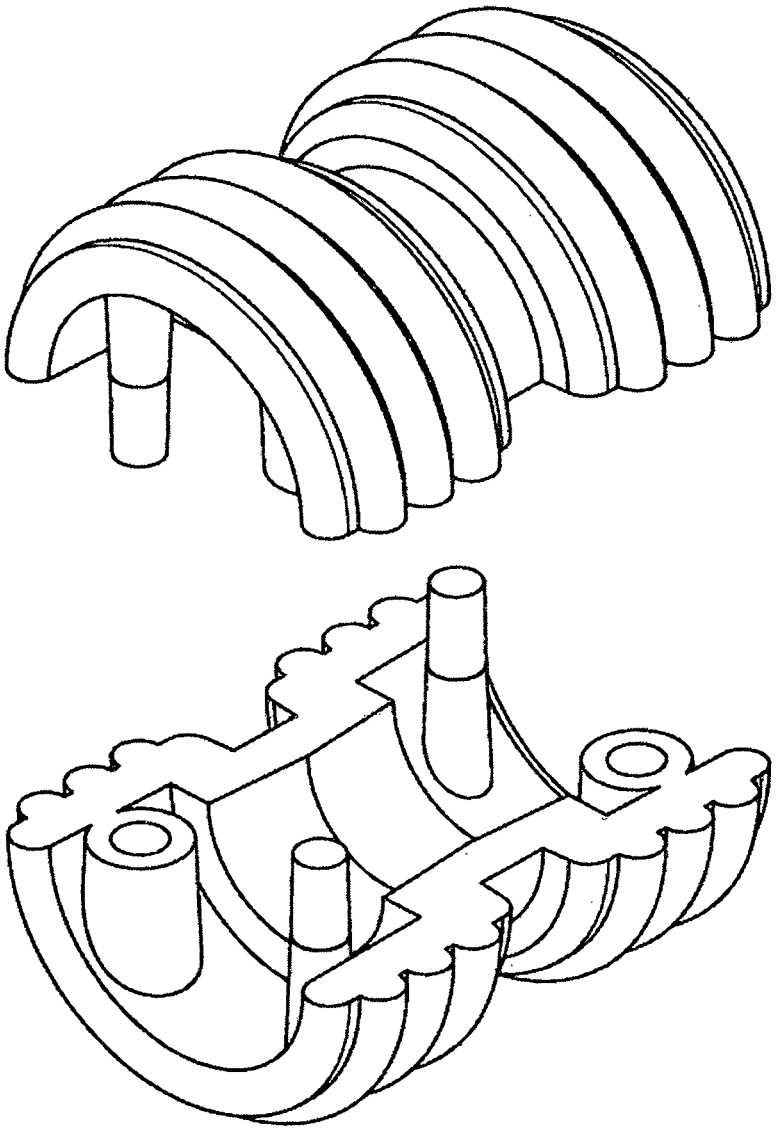
FIG. 18 illustrates a disassembled central piece of the 3-D puzzle depicted in FIG. 1, according to the exemplary embodiment.

The 3-D magnetic puzzle additionally has a north and a south pole parts 6 (see FIG. 1), each of which is divided into two equal parts, providing for rotation of the western and the eastern hemispheres of the 3-D magnetic puzzle. FIG. 4 also illustrates magnets of the movable element 21 and movable element housing 22.

In the disclosed embodiment, the movable elements 2 are implemented in the form of balls. The balls have two different coatings of different colors. In one embodiment, the balls may have two different coatings of different texture that feels different to a user touch.

According to the exemplary embodiment, a 3-D spheric puzzle with movable sectors works as follows. The idea of the puzzle is to expose all the spherical magnets protruded slightly above the surface. In the exemplary version twelve magnets are use, but there a different number of magnets may be used. The magnets be located with one painted or labeled surface side out. Spherical permanent magnets 2 rotate freely in their cavities 4 without falling out. The external set of permanent magnets 2 may move together with the movable sectors 1 both along the equator and along the meridian. Thus, the moving sectors 1 can be shuffled by the player, transferred from the southern hemisphere to the northern one and back, or shuffled in sequence.

Due to the fact that the internal fixed magnets 3 are fixed and oriented with poles in different directions, each movement of the movable sectors 1 causes the spherical magnets 2 rotate with a different side based on the position of the internal fixed magnets 3. Since the different sides of the external spherical magnets 2 have a different appearance (painted in different colors or have a different picture or label on each side), such a movement of sectors leads to a different combination of the appearance of permanent magnets 2.

For example, permanent magnets 2 may be colored yellow and red on both sides, or may have images of open and closed eyes, or numbering on one side and no numbering on the other. The internal and external magnets may be selected in such a way that at least one of their states corresponds to the situation when all permanent magnets marked or painted with the same color 2 are pointing outward with the same pole.

The player's task is to first confuse the state of the puzzle, for example, so that the sides of the magnetic balls marked with one color and another look out if order. Then, the player has to collect from the out of order state all the sides of the magnets of the same color pointing outwards while all the other colors point inwards. Practice shows that this is a tricky and non-trivial task that can take a lot of time. When the movable sectors are moved, magnets located in hollow guides or in guides in the form of hinges interact with each other and change the position of the relative movable sector depending on the environment.

Embodiments of the invention may be embodied in other specific forms without departing from the spirit of the present disclosure. The described embodiments are to be considered in all respects only as illustrative yet not restrictive. The scope of the embodiments is, therefore, indicated by the appended claims rather than by the foregoing description. All changes that come within the meaning and range of equivalency of the claims are to be embraced within their scope.

What is claimed is:

1. A 3-D spherical magnetic puzzle, comprising:

a plurality of movable sectors configured to host movable elements configured to change a state of the 3-D magnetic puzzle, wherein:

the movable sectors are configured to change their positioning relative to each other; and the movable sectors comprising sphere segments with cavities configured to accommodate the movable elements comprising permanent magnets, wherein each of the movable elements is configured to move inside the cavity responsive to a magnetic field provided by the permanent magnets responsive to the movable sectors change their positioning relative to each other and the movable elements are covered with two different coatings of a different texture; and an equatorial belt dividing the 3-D spherical magnetic puzzle into northern and southern hemispheres, wherein the 3-D spherical magnetic puzzle is configured to facilitate rotating of the movable sectors of the northern and the southern hemispheres relative to a north-south axis and the equatorial belt comprises an even number of equal fragments configured to allow rotation of western and eastern hemispheres of the 3-D spherical magnetic puzzle by 180 degrees relative to two mutually perpendicular axes, each of which is perpendicular to the north-south axis.

2. The 3-D spherical magnetic puzzle of claim 1, further comprising an even number of the movable sectors comprising a plurality of magnetic movable elements.

3. The 3-D spherical magnetic puzzle of claim 1, wherein the movable elements have two different color coatings configured to be pointed inward or outward depending on orientation of a magnetic field provided by the permanent magnets.

4. The 3-D spherical magnetic puzzle of claim 1, further comprising the movable sectors having additional magnets to ensure fixation of the movable elements of the 3-D spherical magnetic puzzle in different static positions.

5. The 3-D spherical magnetic puzzle of claim 1, further comprising an inner piece relative to which the movable sectors move, wherein the permanent magnets interacting with the movable elements are located in the inner piece, so that in any static position of the 3-D spherical magnetic puzzle the permanent magnets interact with each other in pairs to cause all movable elements to be facing outward with one of the coatings.

6. The 3-D spherical magnetic puzzle of claim 1, further comprising a north and a south pole part configured to allow for rotation of the western and the eastern hemispheres of the 3-D spherical magnetic puzzle.

7. The 3-D spherical magnetic puzzle of claim 1, wherein the movable elements comprise balls painted with two coatings of different colors.

8. The 3-D spherical magnetic puzzle of claim 7, wherein the balls are covered with two different coatings of a different texture.

9. A method of a 3-D magnetic puzzle, comprising:

obtaining a sphere-shaped 3-D magnetic puzzle, comprising:

a plurality of movable sectors configured to host ball-shaped movable elements configured to change a state of the 3-D magnetic puzzle, wherein:

the movable sectors are configured to change their positioning relative to each other; and the movable sectors comprising sphere segments with cavities configured to accommodate the movable elements comprising permanent magnets, wherein each of the ball-shaped movable elements is configured to move inside the cavity responsive to a magnetic field provided by the permanent magnets responsive to the movable sectors change their positioning relative to each other and wherein the ball-shaped movable elements are covered with two different coatings of a different texture; and an equatorial belt dividing the 3-D spherical magnetic puzzle into northern and southern hemispheres, wherein the 3-D spherical magnetic puzzle is configured to facilitate rotating of the movable sectors of the northern and the southern hemispheres relative to a north-south axis and the equatorial belt comprises an even number of equal fragments configured to allow rotation of western and eastern hemispheres of the 3-D spherical magnetic puzzle by 180 degrees relative to two mutually perpendicular axes, each of which is perpendicular to the north-south axis.

10. The method of claim 9, further comprising rotating the movable sectors of the sphere-shaped 3-D magnetic puzzle to bring the magnetic puzzle to an ordered state, wherein all of the movable elements are in a position with a same color coating or texture pointing outward.

* * * * *